United States Patent [19]

Schwelling

[11] Patent Number: 4,651,610

[45] Date of Patent: Mar. 24, 1987

[54] CHANNEL PRESS

[76] Inventor: Hermann Schwelling, Bahnhofstrasse 115, D-7777 Salem 3/Neufrach, Fed. Rep. of Germany

[21] Appl. No.: 637,899

[22] Filed: Aug. 6, 1984

[30] Foreign Application Priority Data

Aug. 8, 1983 [DE] Fed. Rep. of Germany ..... 3328588

[51] Int. Cl.[4] ..... B30B 9/30; B26D 1/09

[52] U.S. Cl. ..... 83/636; 83/694; 83/697; 100/98 R

[58] Field of Search ..... 83/636, 689, 679, 690, 83/694, 697, 611, 622; 100/98 R

[56] References Cited

U.S. PATENT DOCUMENTS

| | | | |
|---|---|---|---|
| 875,067 | 12/1907 | Green | 83/636 |
| 2,057,928 | 10/1936 | Stahl | 83/679 |
| 2,423,601 | 7/1947 | MacArthur | 83/689 |
| 3,049,988 | 8/1962 | Lindemann et al. | 83/636 |
| 3,962,939 | 6/1976 | Stengle, Jr. | 83/171 |
| 4,449,435 | 5/1984 | Colditz | 83/623 |

FOREIGN PATENT DOCUMENTS

| | | | |
|---|---|---|---|
| 3035464 | 4/1982 | Fed. Rep. of Germany . | |
| 691450 | 10/1930 | France | 83/636 |

*Primary Examiner*—Frank T. Yost
*Assistant Examiner*—Hien H. Phan
*Attorney, Agent, or Firm*—Toren, McGeady and Goldberg

[57] ABSTRACT

In a channel press for producing bales, preferably tied, of non-metallic waste materials, such as office waste and the like, a press piston is reciprocably mounted in a press channel or shaft into which the waste material is introduced. A knife member is mounted on and is movable with the press piston. A stationary counterknife member is located in the press channel. At least the stationary knife has individual teeth each formed with a point. The teeth are located along a line directed oppositely relative to the line of the cutting edge of the movable knife member.

7 Claims, 4 Drawing Figures

CHANNEL PRESS

SUMMARY OF THE INVENTION

The present invention is directed to a channel press for producing bales of non-metallic waste material, preferably tied bales, where a press piston is arranged to reciprocate in a horizontally arranged press shaft or channel into which the waste materials are introduced. A shearing device is located in the press shaft and includes a stationary knife member mounted on the shaft and a movable knife member positioned on the press piston. The stationary knife member acts as a counterknife for the movable knife member.

Such a channel press with a tooth-shaped stationary counterknife is known from the German Offenlegungsschrift 30 35 464 filed by the same inventor. As compared to the state of the art, the new and inventive features and their advantageous effects in the German Offenlegungsschrift involve, at the beginning of each cutting and press stroke, that the material to be cut was pressed by the press piston against the stationary tooth-like or saw tooth-like counterknives and was held by these knives and was prevented from moving to the side and consequently toward the press channel side walls during the cutting process. Such lateral movement would tend to cause an accumulation of the waste material so that an extremely high cutting output would be required in the separating process. Another important feature of the known embodiment was the use of the gradual cutting, that is, the use of an arrowhead-shaped construction of the knife member on the piston for guaranteeing that the cutting operation does not commence over the entire channel or knife width, rather the cutting operation commences at one point and then gradually expands with time, during each press stroke, for cutting across the full width of the knife member.

Based on the knowledge gained from this known state of the art, it is the primary object of the present invention to provide an arrangement of the cutting members, particularly of the stationary counterknife member which affords an improved force distribution over the entire cutting stroke and, in particular, assures that the material to be cut is separated in the center of the channel before the outer teeth or cutting edge parts are engaged.

In accordance with the present invention, in a surprisingly simple manner, the points of the individual teeth of the tooth shaped stationary counter knife member are disposed on a line which is directed oppositely to the line of the arrowhead-like or circular arc-shaped curve of the movable knife member on the piston. The points of the individual teeth are located along a line which is either arrowhead-shaped or preferably in the shape of a circular arc. Based on the present invention, good results are achieved when the knives on the press piston and the counterknife on the housing side of the channel press are both formed on tooth-shaped knife members so that the points of the individual teeth on each of the knife members are aligned opposite one another along the same line of action.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 3:
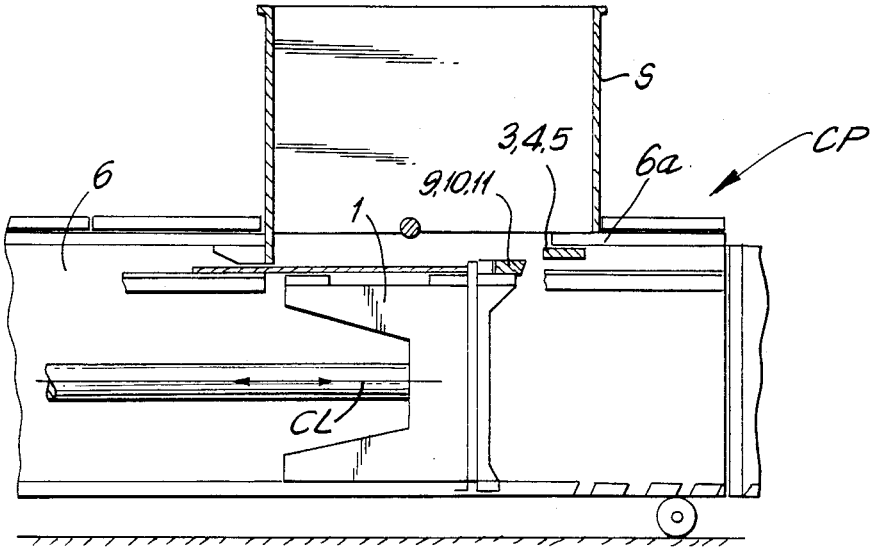
FIG. 3 is a side elevational view of a channel press, partly broken away.
Figure 4:
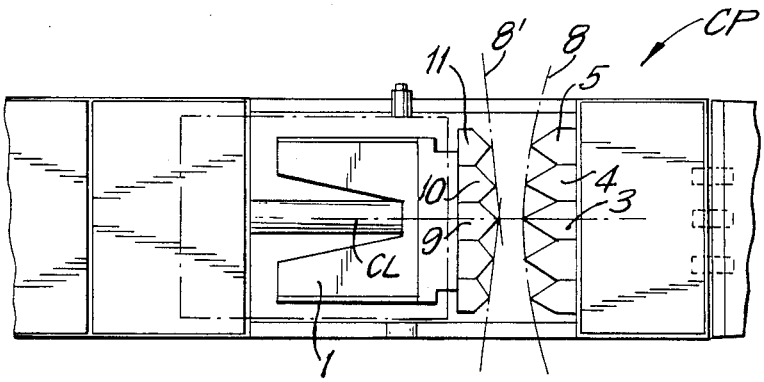
FIG. 4 is a plan view of the channel press shown in FIG. 3.

In FIGS. 3 and 4 a horizontally extending channel press CP is shown with an upwardly extending inlet shaft S for introducing waste material downwardly into a horizontally arranged channel-like press shaft 6. The press shaft is formed by a horizontal upper side 6*a* and a pair of vertical side walls 7 extending downwardly from the upper side to the horizontal bottom of the press shaft 6. A vertically extending plane P spaced between the side walls 7 includes the centerline CL of the press shaft.

Figure 1:
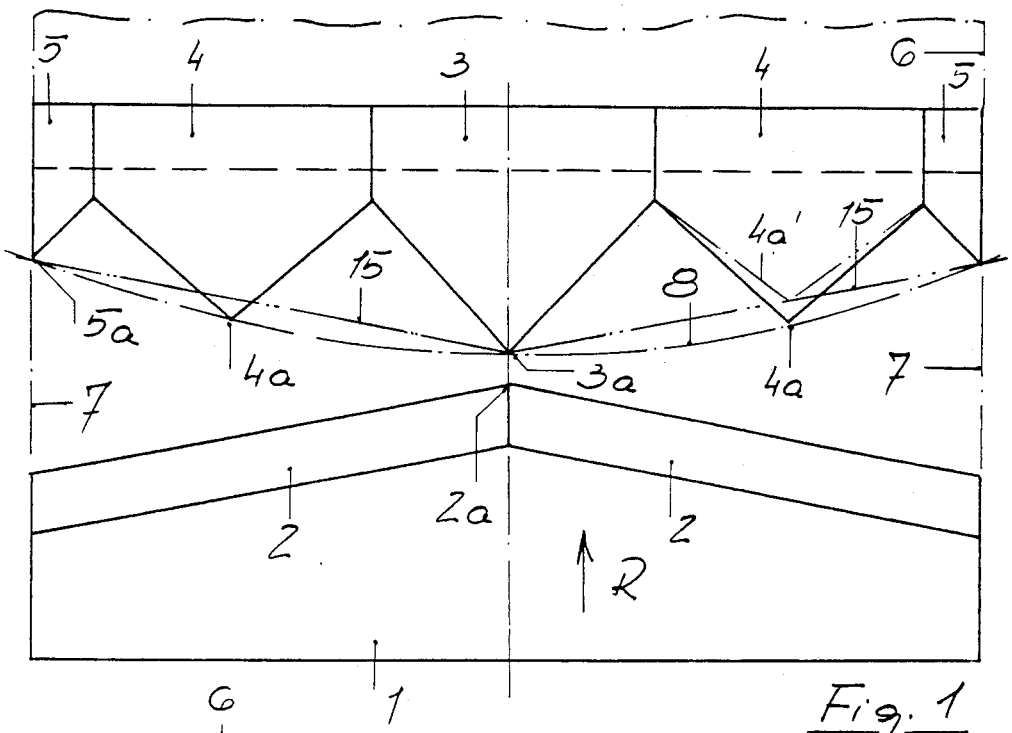
FIG. 1 is a top plan view of the cutting arrangement embodying the present invention.

In FIG. 1, a press piston 1 is shown mounting a knife member 2 on the upper side of the channel press CP and the knife is movable with the press piston in the pressing direction R. The knife member 2 has an arrowhead-like shape so that the knife has an arrowhead point 2*a* which leads the knife member in the cutting or pressing direction R with the parts of the knife member on the opposite sides from the point 2*a* sloping rearwardly relative to the cutting direction. The stationary or counterknife member mounted on the press shaft 6 or on its side walls 7 is positioned opposite the knife member 2 as it moves in the cutting direction. The stationary or counterknife member is a tooth-shaped member made up of individual teeth 3, 4, 5 with each tooth having a corresponding point 3*a*, 4*a*, 5*a* located along a line 8 which is a circular arc and is convex in the direction opposite to the cutting direction R. As can be seen in FIG. 1, the points 3*a*, 4*a*, 5*a* are located on the line 8. In effect, both the line 8 of the tooth points 3*a*, 4*a* and 5*a* and the line of the cutting edge of the knife member 2 and its arrowhead-point 2*a* are generally convex in the direction facing the other.

Figure 2:
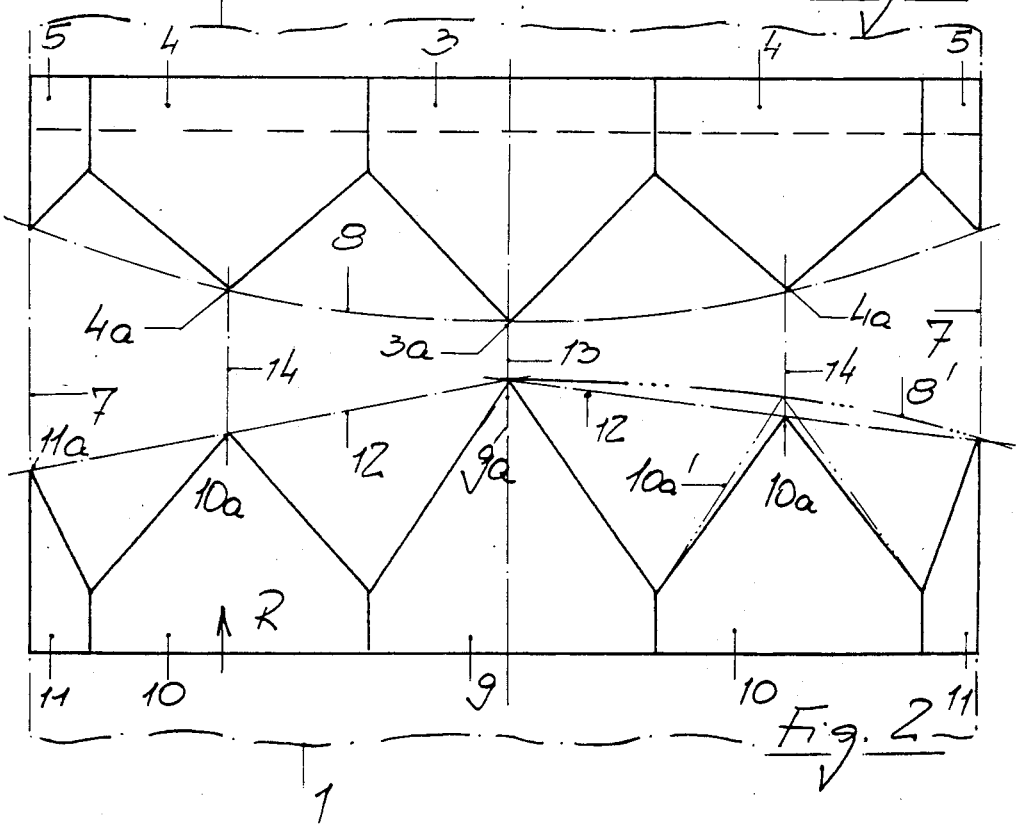
FIG. 2 is a similar view of another embodiment of the cutting arrangement shown in FIG. 1.

In FIG. 2 another embodiment is shown where the arrangement of the stationary counterknife member is formed of the individual teeth 3, 4, 5 as set forth in FIG. 1, however, the movable knife member located on the piston 1 is made up of individual teeth 9, 10, 11 each having a corresponding point 9*a*, 10*a*, 11*a*, similar to the teeth of the stationary knife member. The points 9*a*, 10*a*, 11*a* may be located along a circular arc 8' or along a line 12 corresponding generally to the arrowhead-like line in FIG. 1. Note if the points of the individual teeth 9, 10, 11 are located along the circular line the point 10*a* extends toward the stationary knife member from the position of the point 10*a* when located on the arrowhead-like line 12. Each of the corresponding points 3*a*–9*a*, 4*a*–10*a* are located along a common line of action 13, 14.

In this second embodiment of the invention it is possible to utilize a circular arc 8, 8' for the location of the points of the teeth or to replace the circular arc with an arrowhead-shaped line 12, 12 wherein the position of the points 4*a*, 4*a'* and 10*a*, 10*a'* are displaced relative to one another in accordance with the use of either the circular arc or the arrowhead shaped line for locating the points.

In the arrangement shown in FIG. 1, the point 2*a* of the knife member 2 on the piston 1 is located along the same line of action as the middle point 3*a* of the teeth making up the stationary knife member. In FIG. 2, whether the points are located along a circular arc or an arrowhead-shaped line, the points of the individual teeth are aligned opposite one another along the lines of action 13, 14.

With these two alternative arrangements of the cutting edge or points of the knife members, the cutting operation is solved in a simple manner.

While specific embodiments of the invention have been shown and described in detail to illustrate the application of the inventive principles, it will be understood that the invention may be embodied otherwise without departing from such principles.

I claim:

1. In a channel press for producing compacted bales of non-metallic waste material, such as office wastes, comprising a horizontally arranged channel-like press shaft with a horizontal centerline having a horizontal upper side and vertically extending side walls with a vertically extending plane spaced between said side walls and including the centerline of said press shaft, a press piston arranged to reciprocate horizontally in said horizontally arranged press shaft into which the waste materials are introduced, a shearing device for cutting the waste material introduced into the press shaft comprising a horizontally arranged planar stationary tooth-shaped first knife member mounted on the upper side of said press shaft and a horizontally arranged planar second knife member mounted on said press piston for horizontal reciprocating movement therewith and for cooperating cutting action with said first knife member whereby said second knife member moves in the cutting operation from a first position spaced from said first knife member toward said first knife member to a second position where said second knife members moves past said first knife member effecting the cutting operation, wherein the improvement comprises that said stationary first knife member has a number of laterally spaced teeth each having a point and the points of said teeth being disposed in spaced relation along a horizontal generally convexly shaped first line bowed toward said second knife member in the first position with the first line being generally symmetrical relative to the centerline of said press shaft, said second knife member having at least one cutting edge extending along a horizontal generally convexly shaped second line positioned opposite and bowed toward the first line of said knife member with said second line being symmetrical relative to the centerline of said press shaft so that in the cutting operation as said second line moves from the first position toward said first line, said second line initially crosses said first line on the centerline of said press shaft and then progressively crosses the first line outwardly toward the side walls of said press shaft.

2. In a channel press, as set forth in claim 1, wherein said first line is arrowhead-like shaped.

3. In a channel press, as set forth in claim 1, wherein said first line is a circular arc.

4. In a channel press, as set forth in claim 1, wherein said second knife member is a tooth-shaped knife member with each of said teeth having a separate point and with said points being located in spaced relation along said second line.

5. In a channel press, as set forth in claim 4, wherein said second line is arrowhead-like shaped.

6. In a channel press, as set forth in claim 4, wherein said second line is a circular arc.

7. In a channel press, as set forth in claim 4, wherein each of said points on said teeth of said first knife member is aligned opposite an individual one of said points on said teeth on said second knife member.

* * * * *